United States Patent [19]

Lowe

[11] Patent Number: 4,860,936

[45] Date of Patent: Aug. 29, 1989

[54] METHOD AND STRUCTURE FOR ATTACHING ADJUSTABLE BACKPACK STRAPS

[76] Inventor: Greg E. Lowe, 4172 Piedra Ct., Boulder, Colo. 80301

[21] Appl. No.: 11,250

[22] Filed: Feb. 5, 1987

Related U.S. Application Data

[63] Continuation-in-part of Ser. No. 570,662, Jan. 13, 1984, abandoned.

[51] Int. Cl.[4] ..... A45F 3/08

[52] U.S. Cl. ..... 224/210; 224/196

[58] Field of Search ..... 224/151, 153, 209–216, 224/257–263, 321, 195, 196, 197, 154, 155, 156, 281, 282, 330, 331, 907; 410/104, 105; 24/498, 454, 514, 339; 182/204, 205

[56] References Cited

U.S. PATENT DOCUMENTS

| | | | |
|---|---|---|---|
| 347,271 | 5/1943 | Torcheux | 224/153 |
| 990,837 | 5/1911 | Carlson | 224/210 |
| 1,251,192 | 12/1917 | Drummond | 182/204 |
| 1,977,725 | 10/1934 | Heidbrink | 24/514 |
| 3,512,380 | 11/1967 | Winter | 24/514 |
| 3,921,867 | 11/1975 | Farnbach | 224/262 |
| 4,015,759 | 4/1977 | Dreissigacker et al. | 224/262 |
| 4,020,769 | 5/1977 | Keir | 24/513 |
| 4,168,793 | 9/1979 | Knight | 224/261 |
| 4,270,681 | 6/1981 | Ingram | 224/321 |
| 4,298,149 | 11/1981 | Gottschalk et al. | 224/201 |
| 4,616,771 | 10/1986 | Heideman | 224/321 |
| 4,660,751 | 4/1987 | von Dewitz | 224/153 X |

FOREIGN PATENT DOCUMENTS

| | | | |
|---|---|---|---|
| 67669 | 4/1944 | Norway | 224/261 |

*Primary Examiner*—Henry J. Recla
*Assistant Examiner*—Linda Sholl
*Attorney, Agent, or Firm*—Robert E. Harris

[57] ABSTRACT

An adjustable backpack structure including a base member having structure to secure it to a backpack and carrying thereon at least one elongated track spaced from and parallel to the securing structure, a movable member including attachment structures for backpack straps and configured to be movably engaged in a no more than partially encircling fashion by the base member track, and a locking structure to releasably secure the movable member in a selected position and along the base member track whereby the base member may be conveniently sewn or otherwise fastened to a backpack with the track disposed in a direction in which adjustability of the backpack straps is desired, and the movable member carrying the straps released, moved along an unobstructed path adjacent to the track and resecured to the base member along the track at any of a number of positions by releasing and securing the locking structure.

17 Claims, 7 Drawing Sheets

METHOD AND STRUCTURE FOR ATTACHING ADJUSTABLE BACKPACK STRAPS

BACKGROUND OF THE INVENTION

This invention relates generally to the attachment and adjustment of straps to backpacks or rucksacks, and more particularly pertains to an assembly including a base member adapted to be secured to the backpack and including preferably a pair of parallel track members, a movable member adapted to ride the track members in a slidable attached but nonencircling manner through an adjacent unobstructed volume and to carry the backpack straps, and a locking structure to secure the movable member at selected positions along the track members.

DESCRIPTION OF THE RELATED ART

It is generally well recognized in the backpack or rucksack industry that the physical characteristics of an individual wearing a particular sack will require different adjustments of the attachment points of the various body straps and other attachment portions bearing upon the wearer. Generally the attachment portions include shoulder straps, a lower back pad, and often a waist belt. Heretofore the strap portions have been made adjustable by providing a plurality of redundant attachment points or a single attachment point with a plurality of guides to position the effective attachment of the shoulder strap to the backpack. Such redundant attachment points are cumbersome and expensive, and usually require a good deal of effort to change the particular adjustment. Such prior approaches have generally involved substantial labor to provide individual positioning of and sewing of the multiple attachment points.

An example of a backpack design which attempts to overcome the shortcomings of other prior art arrangement is to be found in U.S. Pat. No. 4,479,595 issued Oct. 30, 1984 to Roy T. Opsal. This design is, in effect, a multiple mounting point design. A series of spaced crosspieces are provided to receive a webbing much like a belt through beltloops. A slidable buckle carried on the webbing is of a dimension about the same as the spacing between crosspieces. Thus, the buckle can be captured between any two crosspieces while on the webbing to permit redundant attachment points. However, the webbing is not directly attached to the backpack and thus "floats" between the crosspieces when loads are applied through the buckle. Further, the webbing must be removed from the crosspieces in at least the direction of travel to allow repositioning of the buckle. Since the buckle fully encircles the webbing, the buckle cannot be moved passed any point at which the webbing is attached to the backpack.

SUMMARY OF THE INVENTION

The present invention, which provides heretofore unavailable convenience and economy in attachment of adjustable backpack straps comprises of a structure in which a base member, preferably of a polymer, webbing or similar such material, is produced in a form providing for convenient attachment through sewing, riveting or similar fastener means to a backpack. Carried on the lightweight base member is at least one, but preferably two rail or track members extending in a parallel relationship in the direction in which adjustment of the straps is desired. The base member may be formed by attaching a length of webbing to the backpack inboard of the edges of the webbing such that the edges of the webbing form track members. A movable member including an arrangement, usually slots, adapted to receive the straps is configured to engage and move along the track members in such a fashion as to provide a strong, partially encircling interface with easy and convenient relocation. As used herein, encircling denotes enclosure but not necessarily enclosure equidistant from a point. An unobstructed volume adjacent the track members is provided for free movement of the movable member even at points of attachment of the base member to the backpack. A releasable locking structure is provided between the base member and movable member to secure the movable member at any of a plurality of positions relative to the base member. Thus, the backpack straps may be conveniently positioned on the base member at selected points by sliding the movable member on the track members, and thus adjusted and secured by means of the releasable locking structure. The fasteners attaching the base member to the backpack are positioned to permit movement of the movable member through the unobstructed volume along the length of the track member free of interference by the fastening means.

Accordingly, an object of the present invention is to provide a new and improved method and structure for securing and positioning straps and similar items bearing against a wearer to a backpack.

Another object of the present invention is to provide a new and improved method of structure for providing for adjustment of straps attached to a backpack.

Yet another object of the present invention is to provide a new and improved method and structure for attaching an adjustable strap securing means to a backpack proper in a manner that permits movement free of interference by the attachment points of the structure to a backpack as a result of a nonencircling interface between the fixed and movable portions of the structure.

These and other objects and features of the present invention will become apparent with consideration of the following description.

DESCRIPTION OF THE INVENTION

Figure 1:
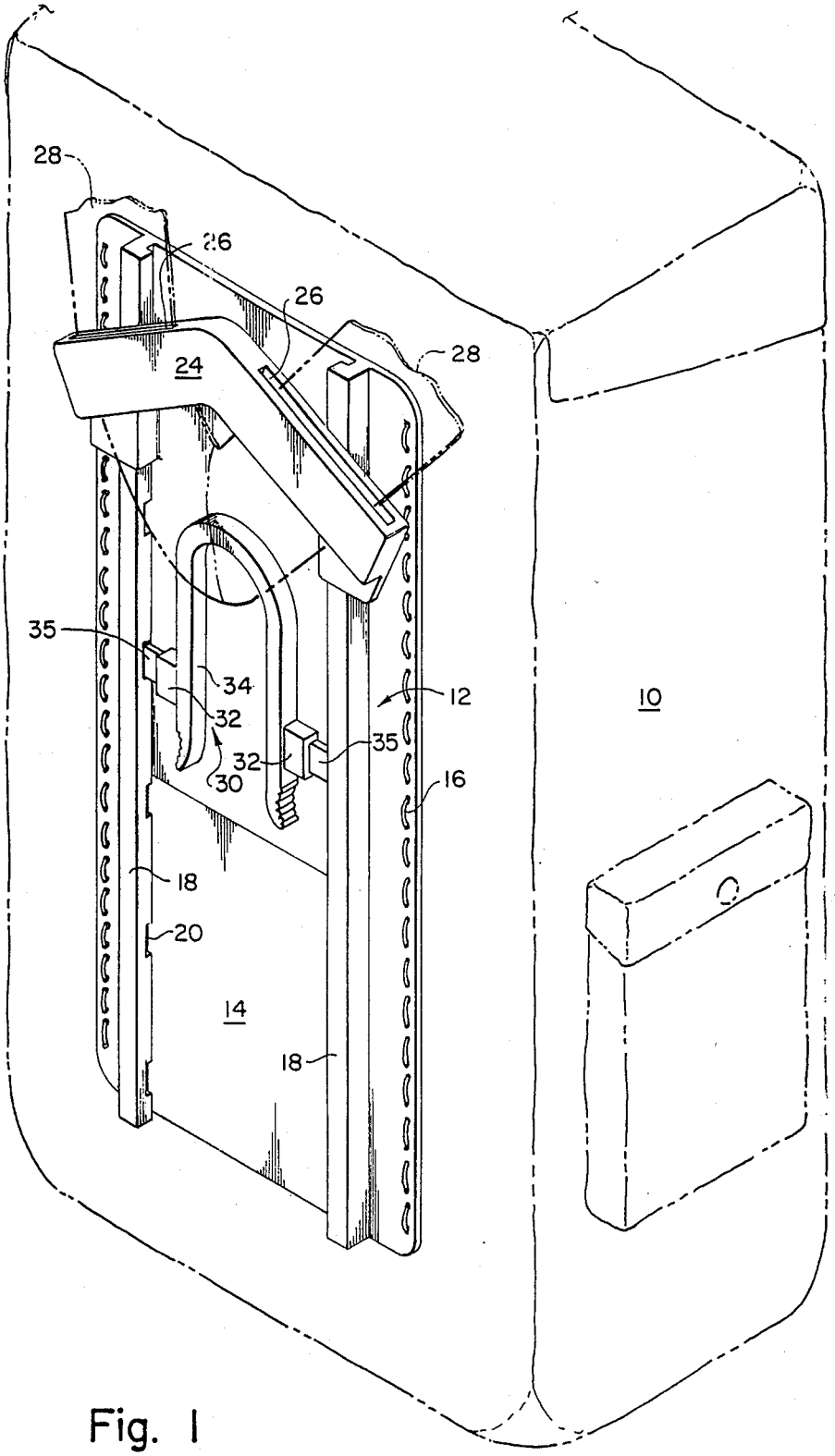
FIG. 1 is a perspective view of a typical backpack arrangement including a shoulder strap attachment means in accord with the instant invention.

Turning now to the drawings, wherein like elements are designated by like reference numerals throughout the various figures, backpack 10 including adjustable backpack attachment assembling 12 is shown in FIG. 1. Adjustable shoulder strap attachment assembly 12 includes a base member 14 typically attached by stitches 16 to backpack 10. A pair of parallel undercut rail members 18 are defined on base member 14 and include a plurality of opposed openings 20 defined therein as will be discussed in more detail below. Movable member 24 is configured to engage and slide within rail members 18 but to not fully encircle rail members 18, as is illustrated in more detail in FIGS. 2 and 3. A pair of openings 26 are defined through movable member 24 and adapted to receive backpack shoulder straps 28. Locking assembly 30, which is attached to movable member 24 by enclosures 32 defined thereon, includes a U-shaped distendable member 34 carrying a pair of outward facing dogs 35 on either side thereof. Dogs 35 are arranged to engage a pair of opposed openings 20. Accordingly, movable member 24 may be conveniently slid along rails 18 by depressing U-shaped member 32 to disengage dogs 35, and thereafter secured in place by releasing the pressure on U-shaped member 34 to allow dogs 35 to engage the adjacent opposed openings 20. In actual practice, openings 20 may be closely spaced to provide for finer adjustment. However, for purposes of illustration, FIG. 1 is believed to convey the principle to those skilled in the art.

Figure 2:
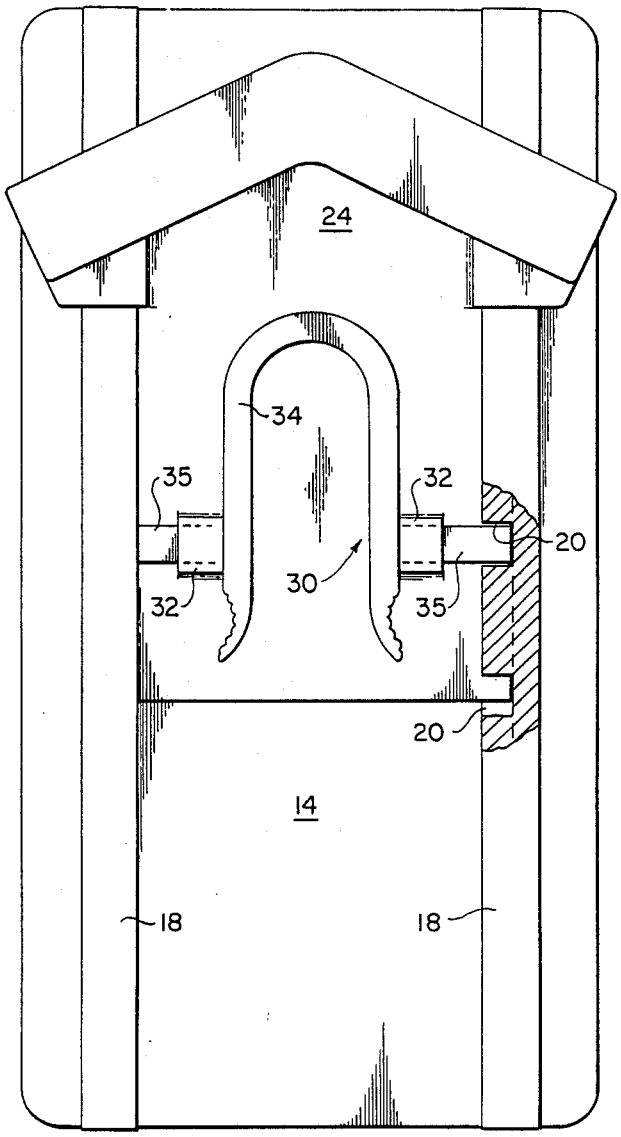
FIG. 2 is a front view of the shoulder strap adjustment means of FIG. 1 which is in part cut away.
Figure 3:
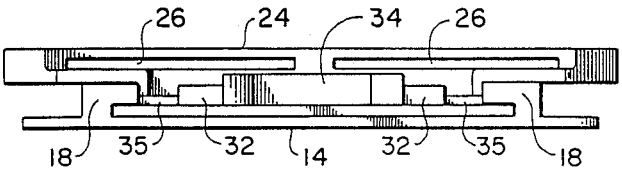
FIG. 3 is a top view of the structure set forth in FIG. 2.

Thus, as will be particularly apparent in FIG. 3, movable member 24 is configured to engage and fit under the undercut portions of opposed rail members 18 thereby movably attaching movable member 24 to base member 14 in a partially but not fully encircling fashion. Unless otherwise secured, movable member 24 will readily slide along rail members 18. However, as is shown in FIG. 2, openings 20 defined in rails 18 are configured to receive dogs 35 and thus prevent movement of movable member 24. By compressing U-shaped member 34, dogs 35 may be retracted from openings 20 thereby permitting positioning of movable member 24 to the desired location, whereupon dogs 35 can again engage an opposed pair of openings 20. As discussed above, openings 20 may be defined closely adjacent one another to provide for fine adjustment of movable member 24 relative to base member 14. Also, though FIGS. 1 through 3, and the other figures of this description, particularly pertain to adjustable attachment assembly 12 configured to receive shoulder straps 28, it will be readily recognized to those skilled in the art that a similar assembly could readily be configured to carry a backpack attachment, or a backpad, etc. Further, it will be recognized by those skilled in the art that a polymeric base member 14, molded of, for instance, urethane plastic, will have sufficient flexibility to facilitate attachment by sewing and provide adequate conformity to the somewhat pliable back pack 10 while still having sufficient rigidity to permit movable member 24 to slide therealong.

Figure 4:
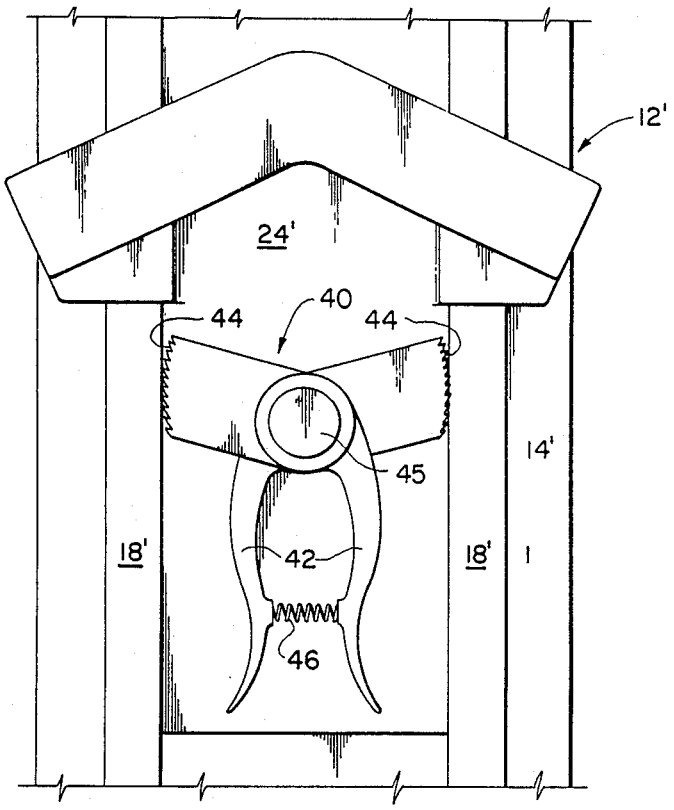
FIG. 4 is a front view of a structure similar to that of FIG. 2, but illustrating a different locking structure.

As shown in FIG. 4, a modified backpack attachment assembly 12' is illustrated. Basically, base member 14' is essentially identical to that illustrated in FIG. 1 except that the opposed holes 20 of FIG. 1 are omitted. Movable member 24' also is essentially as shown in FIG. 1 except that camming locking structure 40 is utilized. As shown, locking structure 40 includes a pair of member 42 having notched, arcuate camming surfaces 44 on opposed ends thereof. Members 42 are attached one to the other and to movable member 24' by pivot 45 such that camming surfaces 44 can effectively be retracted by grasping members 42 and rotating around pivot 45 in a scissor fashion. However, when released, spring 46 urges the notched camming surfaces 44 into engagement with adjacent rails 18'. Accordingly, particularly when an upward load is applied such as would be applied by shoulder straps from movable member 24' relative to base member 14', notched camming surfaces 44 will securely jam against adjacent rails 18' thereby providing for secure locking of movable member 24' relative to base member 14'. Since, in the case of shoulder strap load application, the load in essentially in one direction, camming locking structure 40 is quite effective for this particular purpose. For bidirectional loads, locking assembly 30 of FIG. 1 is more positive, though two opposed camming locking means could also be used. Those skilled in the art will readily recognize the advantages and disadvantages of the two approaches. It is to be understood that the particular embodiment best suited for a given use may be dependent upon the particular use of the underlying invention.

Figure 5:
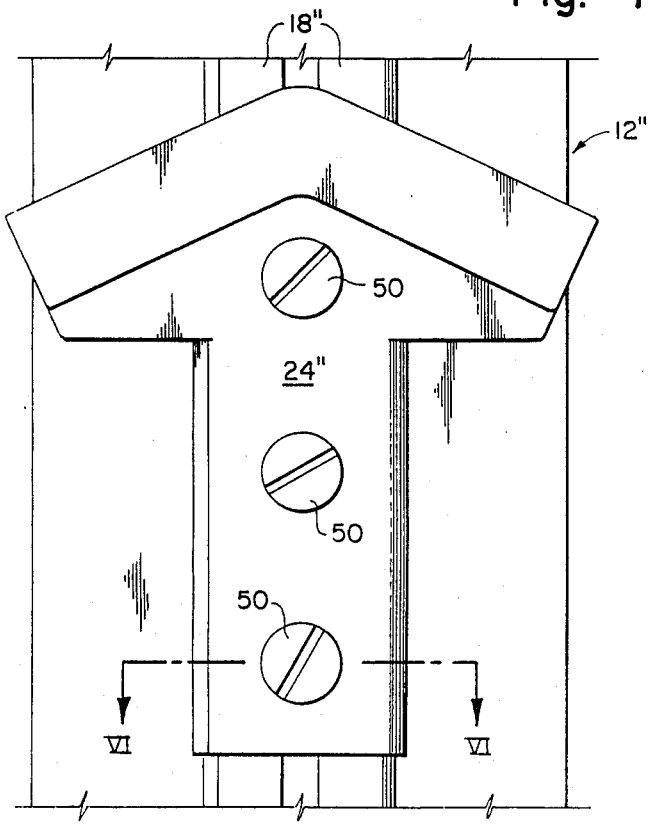
FIG. 5 is a front view of yet another variation of an adjustable shoulder strap attachment means according to the instant invention.
Figure 6:
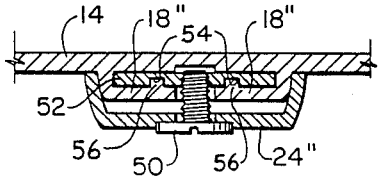
FIG. 6 is a section view along section line VI—VI illustrating the engagement and locking structure of FIG. 5.

FIG. 5 illustrated yet another configuration of the invention. As shown, adjustable backpack attachment assembly 12" includes all of the functional features of the previous embodiment, though in a different configuration. For instance, base member 12" again includes a pair of opposed rails 18", but the rails are more closely spaced to define an undercut slot therebetween. Similarly, movable member 24" again engages but does not encircle undercut rails 18", though the locking assembly differs. With reference to FIG. 6, which is a sectional view along section line VI—VI, the section view illustrates the manner in which movable member 24" rides on the outer portions of opposed rail members 18". However, screws 50 extend through movable member 24" and are threadedly engaged by plate 52 which extends beneath the undercut portions of rail members 18". Thus, by loosening screws 50, shown in FIG. 5 as being three in number, the clamping action is released and movable member 24" may be slid along rails 18" in an apparent manner with screws 50 moving along the slot defined by rails 18". However, when movable member 24" is appropriately positioned, screws 50 may again be tightened thus providing for a clamping of plate 52 bearing upon the underside of undercut rail members 18" and also a clamping of movable member 24" to base member 14". In this embodiment, either base member 14" or movable member 24" may be viewed as partially encircling the other.

Figure 7:
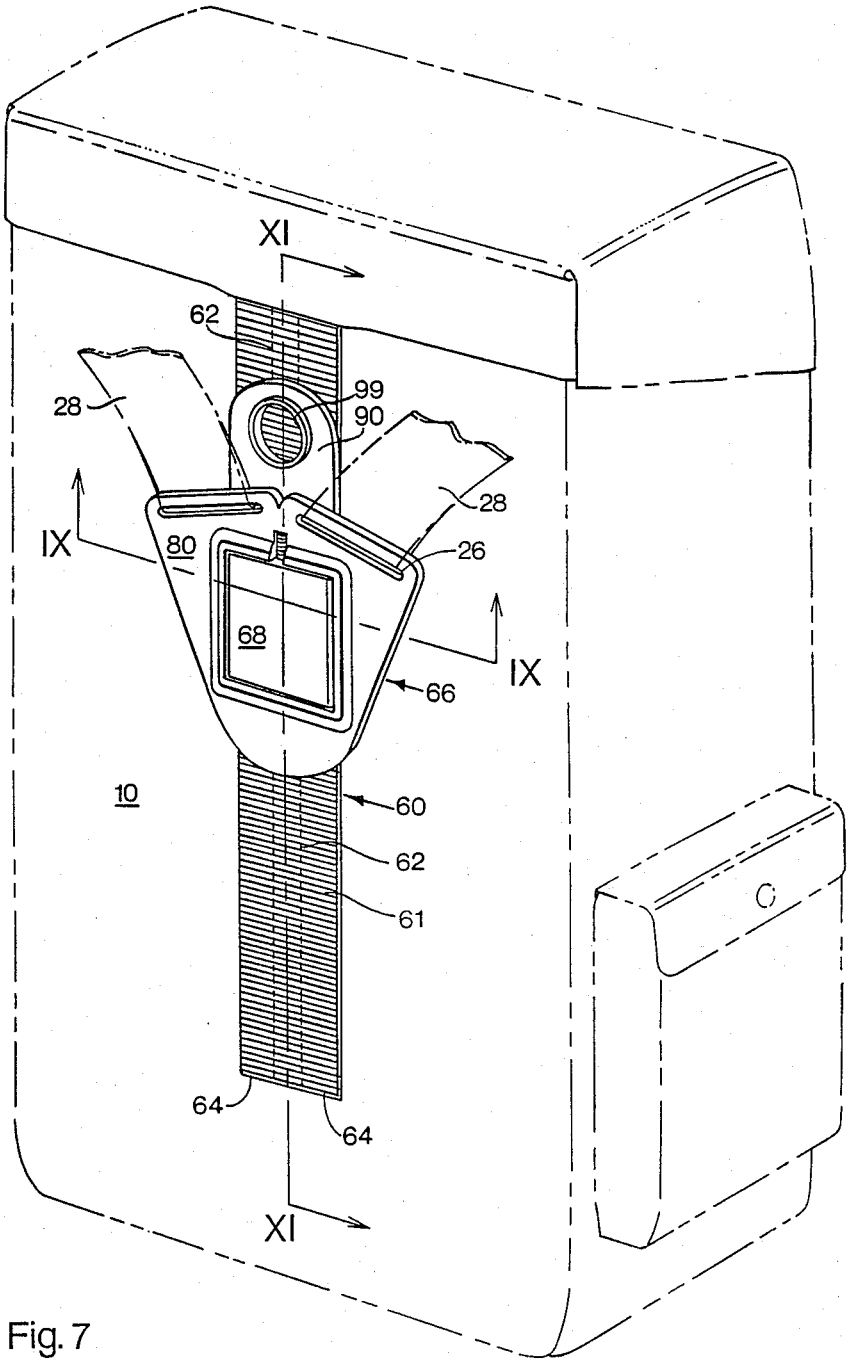
FIG. 7 is a perspective view similar to that of FIG. 1, but illustrating another embodiment of a shoulder strap attachment means in accord with the instant inventions.
Figure 8:
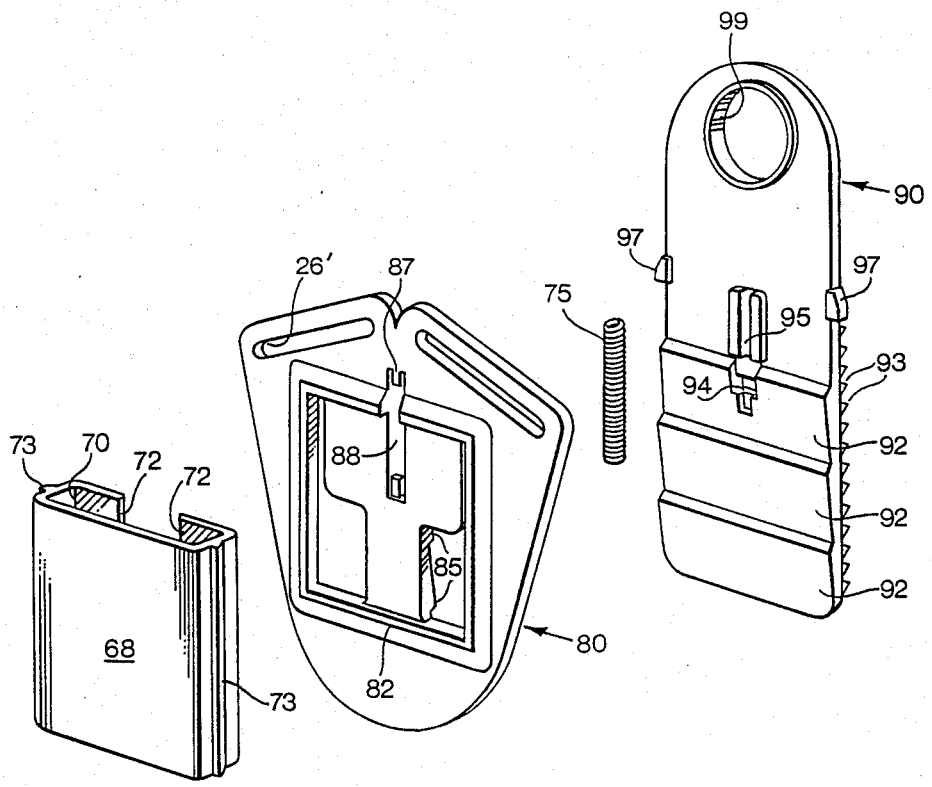
FIG. 8 is an exploded view of the movable member shown in FIG. 7.

A similar but simpler arrangement is illustrated in FIG. 7 wherein straps 28 are again shown as adjustably attached to backpack 10. As shown, base member 60 is formed of conventional web material 61, i.e., conventional textile webbing, attached at the central portion thereof to backpack 10 by stitching 62 which defines a pair of outboard pliant tracks 64. Movable member 66, which carries straps 28, is releasably attached to and slidable along tracks 64. As in all the embodiments of this invention, an unobstructed volume defined by the greatest cross-section of movable member 66 taken orthogonal to tracks 64, with the cross-section extended in the direction of tracks 64 at least twice, and preferably several times the length of movable member 66. This volume must be unobstructed at the attachment points, i.e., stitching 62 of base member 60 to permit useful range of adjustment to movable member 66. Such unobstructed movement is the result of the partial (i.e., greater than 180°) but less than full encirclement of one of the base member 60 and the movable member 66 by the other at the slidable interface therebetween.

FIGS. 8 through 11 illustrate in more detail the structure and operation of base member 60 in conjunction with movable member 66. Movable member 66 includes sleeve structure 68, spring 75, plate structure 80 and wedge member 90. Sleeve structure 68 defines internal opening 70 except at the portion thereof that slot surfaces 72 define a longitudinal slot. Abutments 73 are positioned at opposite sides of sleeve structure 68.

Figure 9:
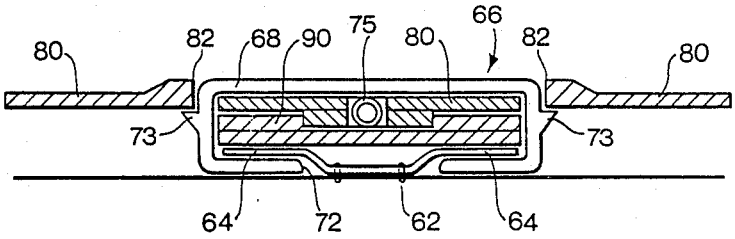
FIG. 9 is a lateral cross-section along section line IX—IX of the assembled base member and movable member shown in FIG. 7.

Plate structure 80 is configured to receive sleeve structure 68 at the rectilinear opening defined by side surfaces 82 with abutments 73 bearing on the portions of plate structure 80 adjacent side surfaces 82 as shown at FIG. 9. A pair of adjacent inclined surfaces 85 are defined at the underside of plate structure 80.

Figure 11:
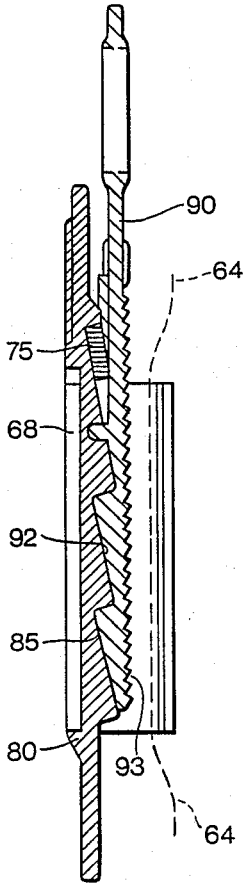
FIG. 11 is a cross-sectional view as shown in FIG. 9 with the movable member components in the "release" position.
Figure 10:
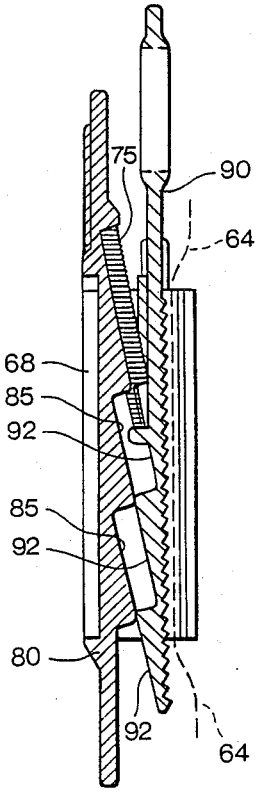
FIG. 10 is a longitudinal cross-section along section line XI—XI of the assembled base member and movable member shown in FIG. 7.

Wedge member 90 is also positioned within and extending through sleeve structure 68. Wedge inclined planes 92 are formed on wedge member 90 to contact and slide on inclined surfaces 85 as is illustrated in FIGS. 10 and 11. Groove projections 93 are also defined on wedge member 90 and oriented to engage pliant track 64, shown in a ghosted manner in FIGS. 10 and 11.

Spring 75 is captured between plate structure 80 and wedge member 90, i.e. by projection 87 and in slot 88 of the former, and by spring receiver 94 at the terminus of spring groove 95 of the latter. Stops 97 are provided on wedge member 90 to limit movement of wedge member 90 to less than the full extension travel of spring 75 and to prevent the inclined planes 92 and inclined surfaces 85 from movement passed the ramp relationship. Opening 99 through wedge member 90 facilitates manual displacement of wedge member 90 relative to plate structure 80 as will be described below.

In operation, spring 75, which is in compression, biases wedge member 90 to the position shown in FIG. 10. As also shown, wedge inclined-planes 92 ride along inclined surfaces 85 to urge projections 93 into nonslip contact with track 64 thereby locking movable member 66, i.e. the assembly of sleeve structure 68, plate structure 80 and wedge member 90 with attached straps 28, to base member 60. However, if wedge member 90 is displaced to further compress spring 75, as shown in FIG. 11, projections 93 are withdrawn as wedge inclined planes 92 seat upon complementary inclined-surfaces 85. This allows movable member 66 to be repositioned on base member 62. Of course release of wedge member 90 allows spring 75 to again expand to again lock movable member 66 in the new position on tracks 64.

Figure 12:
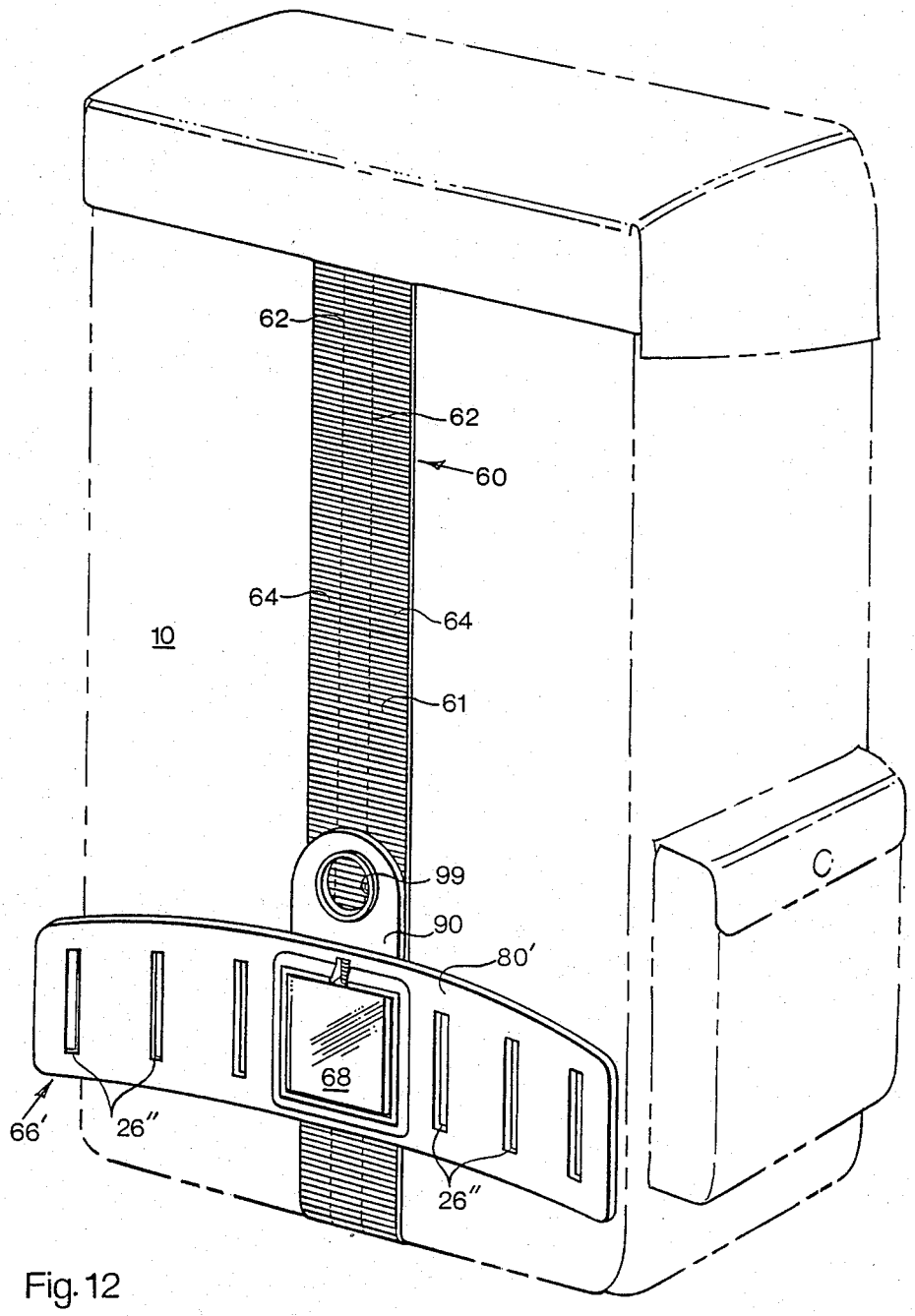
FIG. 12 is a perspective view similar to that of FIG. 7 but illustrating a waist belt embodiment of the attachment means in accord with the instant invention.

The embodiment of FIG. 12 is functionally identical to that of FIG. 7 with the exception of the configuration of movable member 66'. As shown, plate structure 80' is formed with the lateral portion thereof enlarged and including slots 26'' adapted to receive a waistbelt (not shown). Thus, the embodiment of FIG. 12 illustrates another configuration, i.e., a waistbelt arrangement, otherwise the same as that of FIG. 7.

It will be recognized that the various embodiments, i.e. that of FIGS. 1–3, that of FIG. 4, that of FIGS. 5 and 6, that of FIGS. 7–11, and that of FIG. 12 all contain common elements, i.e. a base member adapted to be secured to a backpack, a movable member adapted to engage rails or tracks defined on the base member with a nonencircling interface to slide therealong through an unobstructed volume, and locking means to releasably secure the movable member to the base member. It is anticipated that various other configurations of these elements will be readily apparent and equally operable. Though numerous materials may be employed depending upon a particular nature of the backpack, i.e. internal frame, external frame, etc., in general a somewhat pliable polyurethane material, i.e. a 90 durometer material is contemplated for the base member and the movable member of FIGS. 1 through 6, while a textile web is suggested for the base member of FIGS. 7 through 12. On the other hand, the locking member is usually of a more rigid plastic such as a polycarbonate or Delrin polymeric material, or may also be made of metal. However, the materials mentioned are merely those currently preferred and not critical choices. It is expected that many other choices will serve adequately.

In summary, the adjustable backpack strap attachment assembly disclosed and discussed herein has the advantage of simplicity, lightness and strength. As will be apparent, all of the forces transferred from the assembly to a backpack will be spread over the entire attachment of the base member rather than through indirect attachment. In many prior art arrangements, a selected attachment point bears all of the load and other alternative attachment points are essentially load free. Further, rapid and convenient adjustment over a substantial range is provided the user of the assembly. A particular backpack may be produced by merely attaching the base member, which is amenable to machine sewing or other mechanized attachment means, to a backpack in a straight forward, economical manner. In this fashion, economy and manufacturing case are achieved as well as enhanced performance provided to the user. The nonencircling interface facilitates all of these substantial advantages.

While only the presently preferred embodiment and components of the instant invention have been specified and described in detail, it will be apparent to those skilled in the art that changes and modifications may be made without deviating from the scope of the invention as defined by the following claims.

What is claimed is:

1. Structure for adjustably mounting attachment points to a wall of a pack member, the structure comprising:

a base member including means adapted to be secured to the wall of the pack member and having defined thereon at least one elongated track having opposed ends;

a movable member slidingly carried on the base member at the track, the movable member including attachment point mounting structure and track engaging means for slidably securing the movable member to the base member with the base member and movable member being slidably interfaced with one of such members partially but less than fully encircling the other, and with the attachment point mounting structure being positionable between the ends of the track; and locking means carried on the movable member to releasably secure the moveable member against sliding movement along the track.

2. An adjustable mounting structure as set forth in claim 1 in which the base member tracks comprises a plurality of parallel tracks and the movable member includes track engaging means partially but not fully encircling the parallel tracks.

3. An adjustable attachment structure as set forth in claim 2 in which the parallel tracks comprise a pair of undercut rail members with the undercut portion being on the side opposite the movable member, and with the track engaging means including portions which fit into but do not fully surround the undercut portions to secure the movable member to the base member in a sliding manner.

4. An adjustable attachment structure as set forth in claim 1 in which the locking means comprise a pair of opposed movable dogs biased outward, and in which the base member includes in the track portion a plurality of opposed, spaced openings adapted to receive the movable dogs to secure the movable member to the base member.

5. An adjustable attachment structure as set forth in claim 1 in which the locking means comprise a pair of movable engaging surfaces mounted on the movable member and adapted to bear upon the track to releasably secure the movable member to the base member and preclude sliding movement.

6. An adjustable attachment structure as set forth in claim 5 in which the engaging surfaces comprise a pair of toothed, curved surfaces pivotally secured to the movable member at a common pivot point and biased to rotate against the track at opposed portions there.

7. An adjustable attachment structure as set forth in claim 1 in which the track includes a pair of undercut, inwardly facing rails defining an undercut, open groove and the movable member and locking means includes a locking plate fitting across the undercut portion of the rails and attached to the movable member by at least one threaded fastener extending through the groove and carried in threads in the locking plate, whereby the threaded member may be tightened to lock the movable member to the base member, or alternatively loosened to permit the movable member and locking plate to slide along the base member with the threaded member moving along the open portion of the groove.

8. An adjustable attachment structure as set forth in claim 1 in which the base member comprises a length of webbing adapted to be secured to the wall of the pack member centrally along the length thereof to define two opposed track members on side portions of the webbing, and the movable member includes a pair of slots having opposed sides and an open end defined therein with each engaging a side portion track member of the webbing.

9. An adjustable attachment structure as set forth in claim 8 in which the locking means comprise a surface defining one of the opposed sides of each of the movable member slots, biasing means urging such surface into locking contact with the webbing, and inclined plane means permitting retraction of the surface from the webbing.

10. An adjustable mounting structure as set forth in claim 1 in which the base plate track defined thereon comprises a plurality of parallel tracks and the movable member includes track engaging means contacting the parallel tracks.

11. An adjustable attachment structure as set forth in claim 10 in which the parallel tracks comprise a pair of undercut rail members with the undercut portion being on the side opposite the movable member, and in which the track engaging means includes portions which fit into the undercut portions to secure the movable member to the base plate in a sliding manner.

12. An adjustable attachment structure as set forth in claim 1 in which the locking means comprise a pair of opposed movable dogs biased outward, and in which the base plate includes in the track portion a plurality of opposed, spaced openings adapted to receive the movable dogs to secure the movable member to the base plate.

13. An adjustable attachment structure as set forth in claim 1 in which the locking means comprise a pair of movable engaging surfaces mounted on the movable member and adapted to bear upon the base plate to releasably secure the movable member to the base plate and preclude sliding movement.

14. An adjustable attachment structure as set forth in claim 15 in which the engaging surfaces comprise a pair of toothed, curved surfaces pivotally secured to the movable at a common pivot point and biased to rotate against the base plate at opposed portions thereof.

15. An adjustable attachment structure as set forth in claim 1 in which the track includes a pair of undercut, inwardly facing rails defining a groove and the movable member and locking means include a locking plate fitting across the undercut portion of the rails and attached to the movable member by at least one threaded fastener extending through the groove and carried in threads in the locking plate, whereby the threaded member may be tightened to lock the movable member to the base plate, or alternatively loosen to permit the movable member and locking plate to slide along the base plate with the threaded member moving along the groove.

16. A method of movably adjusting attachment points relative to a wall of a pack structure, the method comprising sliding a movable member having attachment points defined thereon to a desired position along at least one track such that said attachment points are positioned adjacent to and along said track said track being defined on a base member attached to the pack member with one of the movable member and base member partially but not fully encircling the other;

securing releasable locking means to preclude movement between the movable member and the track;

securing releasable locking means to preclude movement between the movable member and the track; and releasing the locking means to again permit sliding movement and repositioning of the attachment points relative to and along the base member and pack member.

17. An adjustable attachment structure comprising:

a base plate including means adapted to be secured to a wall of a pack member and having thereon a pair of undercut inwardly facing parallel rails defining a groove therebetween on the surface of the base plate adapted to face away from the pack member;

a movable member having defined thereon attachment points, and fitting in a sliding manner to the base plate along the surfaces of the parallel rails with the attachment points adjacent and along the rails; and locking means comprising a locking plate fitting into the undercut portions of the parallel rails and attached to the movable member by a fastener extending through the groove to engage the locking plate and bearing upon the movable member, whereby the fastener may be loosened to permit the movable member to slide relative to the base plate or tightened to lock the movable member relative to the base plate.

* * * * *